US007667563B2

(12) United States Patent
Blanke

(10) Patent No.: US 7,667,563 B2
(45) Date of Patent: Feb. 23, 2010

(54) TRANSFORMER

(75) Inventor: Joerg Blanke, Lemgo (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 12/064,443

(22) PCT Filed: Aug. 30, 2006

(86) PCT No.: PCT/EP2006/008461

§ 371 (c)(1),
(2), (4) Date: Feb. 21, 2008

(87) PCT Pub. No.: WO2007/025725

PCT Pub. Date: Mar. 8, 2007

(65) Prior Publication Data

US 2008/0246575 A1 Oct. 9, 2008

(30) Foreign Application Priority Data

Aug. 30, 2005 (DE) ..... 10 2005 041 131

(51) Int. Cl.

| | |
|---|---|
| ***H01F 27/06*** | (2006.01) |
| ***H01F 21/06*** | (2006.01) |
| ***H01F 27/29*** | (2006.01) |
| ***H01F 5/00*** | (2006.01) |
| ***H01F 27/28*** | (2006.01) |

(52) U.S. Cl. ..... 336/65; 336/131; 336/192; 336/200; 336/229; 336/222

(58) Field of Classification Search ..... 336/65, 336/223, 232, 200, 229
See application file for complete search history.

(56) References Cited

U.S. PATENT DOCUMENTS

| | | | | |
|---|---|---|---|---|
| 4,956,627 | A * | 9/1990 | Pfizenmaier et al. | 336/65 |
| 4,967,175 | A * | 10/1990 | Berg et al. | 336/65 |
| 6,292,081 | B1 * | 9/2001 | Armfield et al. | 336/65 |
| 2002/0075115 | A1 | 6/2002 | Yeh et al. | |
| 2005/0068149 | A1 | 3/2005 | Fushimi | |
| 2005/0093672 | A1 * | 5/2005 | Harding | 336/223 |

FOREIGN PATENT DOCUMENTS

| | | | |
|---|---|---|---|
| DE | 33 22 004 | A1 * | 12/1984 |
| DE | 3322004 | A1 * | 12/1984 |
| DE | 40 29 666 | A1 | 3/1992 |
| EP | 1 104931 | A2 * | 6/2001 |
| JP | 09 017652 | A | 1/1997 |
| WO | 88/07257 | A1 | 9/1988 |

* cited by examiner

*Primary Examiner*—Anh T Mai
*Assistant Examiner*—Mangtin Lian
(74) *Attorney, Agent, or Firm*—DeMont & Breyer LLC

(57) ABSTRACT

The present invention relates in general to the field of interface technology. Electronic components, such as modular converters for measurement control and regulation technology, in particular isolation amplifiers, are known from interface technology. Such isolation amplifiers can be used for galvanic separation, conversion, amplification and filtering of standard, normal signals and for matching analog signals. These isolation amplifiers are galvanically separated from one another in the input, output and supply circuits. According to the invention, a separate component of a transformer is integrated for separation into a circuit board of an isolation amplifier with the aid of SMD mounting technology, wherein the transformer contains a combination of inductive components, consisting of a magnetic core and a winding, and a substrate which contains internal printed conductors that form planar short-circuit windings.

12 Claims, 4 Drawing Sheets

TRANSFORMER

BACKGROUND OF THE INVENTION

1. Technical Field

Figure 1:
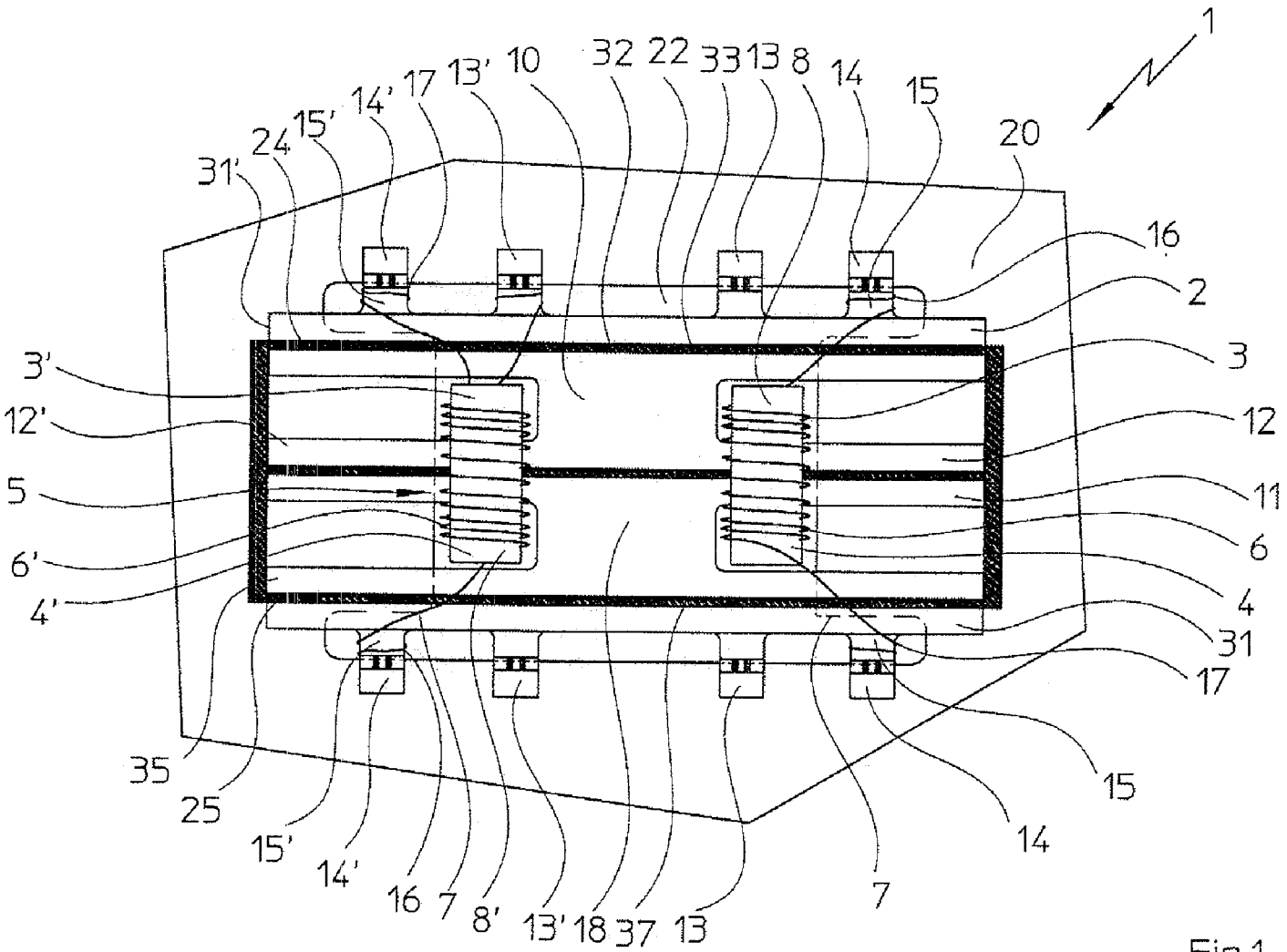

The present invention relates in general to the field of interface technology. Electronic components, such as modular converters for measurement control and regulation technology, particularly isolation amplifiers, are known from interface technology. Such isolation amplifiers can be used for galvanic separation, conversion, amplification and filtering of standard, normal signals and for matching analog signals. These isolation amplifiers are galvanically separated from one another in the input, output and supply circuits. This separation prevents different sensor circuits and actuator circuits from affecting one another due to the interruption of ground loops resulting from the grounding of the different circuits.

2. Background in Prior Art

Galvanic separation is accomplished by inductive passive components which are used in power conversion. The transformer is an important passive component in electrical engineering. AC voltages can be stepped up or down with the aid of a transformer. If, as in the present example, the transformer is not used for power conversion but rather for analog information transfer, the transformer is properly called a 1:1 transformer. There is also the possibility that the transformer may be used for both power conversion and signal transfer. Both electronic components operate with the same principle of inductive components. The electronic components of isolation amplifiers, including the transformer, are generally mounted on circuit boards; the circuit board may be arranged in an insulating material housing and equipped with spiral, plug-in or spring-clip terminals. The insulating material housings can be clipped onto carrier rails according to EN 50022 and thus be mounted in switchgear cabinets, for instance. The overall space available in switchgear cabinets is limited, however. Because of this limitation there exists a development requirement to minimize the overall size of electronic components, including the insulating material housing, and to manufacture them more economically.

Isolation amplifiers that are equipped with one or more passive transformers are sufficiently known from prior art, for instance, from the product catalog "Signal converter interface 2002" TNR 5123474/04.01.02-00 and the "new product catalog 2004" TNR 5154139/04.15.04-00 of Phoenix Contact GmbH & Co. KG.

Such isolation amplifiers consist of a plurality of electronic components. One of these electronic components is the transformer that serves for galvanic separation of the information signals. If there is no path by which charge carriers can flow from one circuit into another that is immediately adjacent, the two circuits are said to be galvanically separated. Information exchange between galvanically separated circuits is possible via the transformer. The transformer consists, for instance, of an annular core of soft magnetic material, which is surrounded by at least two turns of insulated conductive wire. The difficulty is to mount the transformer quickly, economically and in a space-saving manner on the circuit board of the isolation amplifier, for instance. Mounting a transformer on a circuit board therefore sets higher requirements for mounting technology. In order to mount a transformer using SMD mounting technology (SMD=surface mounting device), in which the component to be mounted is manipulated by means of a suction pipette and mounted on the surface of a circuit board, EP 1 104 931 A2 proposes using a modified annular core that has two surface areas on its narrow exterior side that form a contact surface, these areas serving to place the annular core on a carrier board and mount it thereon. The carrier board can in turn be mounted on a circuit board. DE 38 345 90 A1 describes something similar. The disadvantage of these structural arrangements is that the overall height resulting from the circuit board, the carrier board and the transformer arranged thereon is not suitable to reduce the overall width of isolation amplifiers.

DE 203 09 843 U1 proposes using a transformer that can be processed with SMD technology; it has an annular core with arranged support feet, whereby the carrier plate is unnecessary and the annular core can be directly mounted on the circuit board. With this design, the overall height is reduced by the elimination of the carrier plate, but the essential disadvantage remains that the annular core of the transformer is arranged vertically on the circuit board and thus an excessive overall height results.

DE 42 14 789 C1 therefore takes the path of mounting the annular core of the transformer horizontally on the circuit board. The great disadvantage of this design is that the windings can be fixed only with adjustment holes on the circuit board after the annular core has been mounted, and therefore it is not suitable for SMD mounting.

DE 33 18 557 A1 proposes a structural arrangement in a horizontal implementation that is suited for use on circuit boards. Reduction of the overall height is not possible here either.

DE 196 15 921 A1 describes configuration in which a cutout for receiving an annular core is contained in the circuit board. This results in a low overall height that would be suitable for use in isolation amplifiers. The great disadvantage is that mounting the element in a flat structural form is not suitable for SMD mounting technology and thus not suitable for large-scale series production. This structural design also does not meet the higher requirements for air clearance and creepage paths of the EX standard.

The invention is therefore based on the problem of creating an inductive component or transformer for isolation amplifiers of the type mentioned above that avoids the aforementioned disadvantages of the known arrangements, and of specifying a technical solution that makes it possible to produce an economical transformer for isolation amplifiers with simple functional geometry, which has a low overall height and can be mounted on circuit boards with SMD mounting technology and nevertheless meets the high requirements for air clearance and creepage paths of the EX standard.

According to the invention, this problem is solved by the characterizing features of Claim 1. Advantageous implementations and refinements of the invention follow from the subsequent subordinate claims and the descriptions below.

DESCRIPTION OF THE INVENTION

In order to create a transformer with these characteristics of the present invention in a structural form capable of SMD mounting technology and a miniaturized design for narrow insulating material housings, it is proposed to produce an isolation amplifier that has, in a first embodiment, an opening in its circuit board for a separate integratable component of a transformer, the component representing a functional part in the construction of the isolation amplifier. In a second embodiment, the separate integratable component is premounted and constitutes a transformer only after mounting on the circuit board of the isolation amplifier. The transformer in the second embodiment is only completed by closing the short-circuit windings during the soldering. At least part of the short-circuit windings are situated on the main board or the circuit board, with the possibility of flat short-circuit windings. Alternatively, this can also be done in advance by means of a separate solder bridge.

The transmission of analog signals is particularly susceptible to noise in an industrial environment. Modular converters for measurement, control and regulation technology avoid the falsification of analog signals due to external noise parameters. This secures and increases the transmission quality and thus the quality of control loops by a precise conversion, isolation and matching of analog signals. In order to meet this quality standard or the corresponding official standards, it is necessary to develop a transformer component which meets the aforementioned requirements and can be integrated with the aid of SMD mounting technology into the opening of the circuit board, and thus into the narrow insulating housing of the isolation amplifier.

This problem is solved according to the invention by the technical specifications below.

The technical solution lies in the connection of two or more conventionally wound annular cores into a transformer with a primary winding and one or more secondary windings, wherein the inductive components can be connected in parallel or in series. In the simplest construction level, the primary winding is wound on the first annular core and the secondary winding on the second annular core. The two completed magnetic cores are mounted on a one-piece substrate having one or more printed conductors in the interior layer. The mounting can also be done with an SMD mounting robot. The conductor ends of the windings are wound onto the winding regions of the contact surfaces. Electrical contact with the driver circuit, for instance, is produced via the contact surfaces. The winding regions arranged on the connection arms of the substrate are cut into the circuit board of the isolation amplifier so that the complete or prefabricated components of the transformer can lie flat on the circuit board and is thus suitable for SMD soldering. A vacuum suction device can apply suction to the component via the suction surface in the center of the transformer, transport it, position it above the circuit board and set it down. Additionally, the printed conductors of the isolation amplifier are connected on the circuit board of the isolation amplifiers by way of the contact surfaces, by tinning for example, to a complete winding which represents both the output winding of the inductive primary component and the input winding of the inductive secondary component. The material of the substrate constitutes the isolation between the windings by means of its structure. The internal printed conductors are surrounded by at least 0.5 mm of insulating material. In this way, the high requirements with regard to isolation for EX-protected products can be realized. The spacings necessary for the EX-field, as well as the air and creepage gaps for secure dogmatic separation of the primary and secondary windings are permanently determined by the central web and the distance of the printed conductors in the central layers from the edge of the substrate. Two or more short-circuit windings can be realized with an appropriate arrangement of the printed conductors in the substrate, wherein the short-circuit windings can be distributed uniformly on both sides of the inductive components, which simultaneously leads to an improved coupling of the inductive components.

Figure 2:
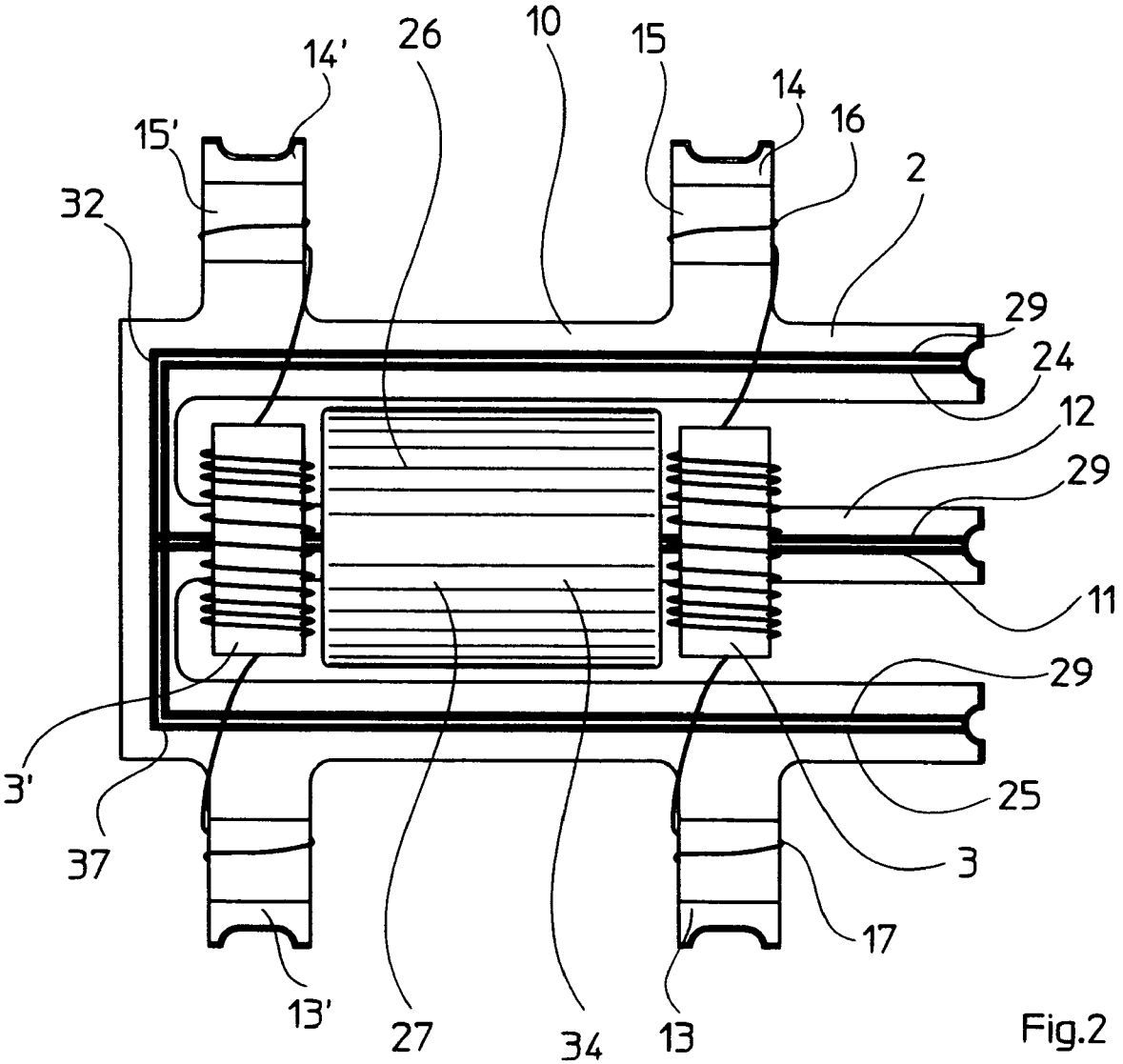
Figure 3:
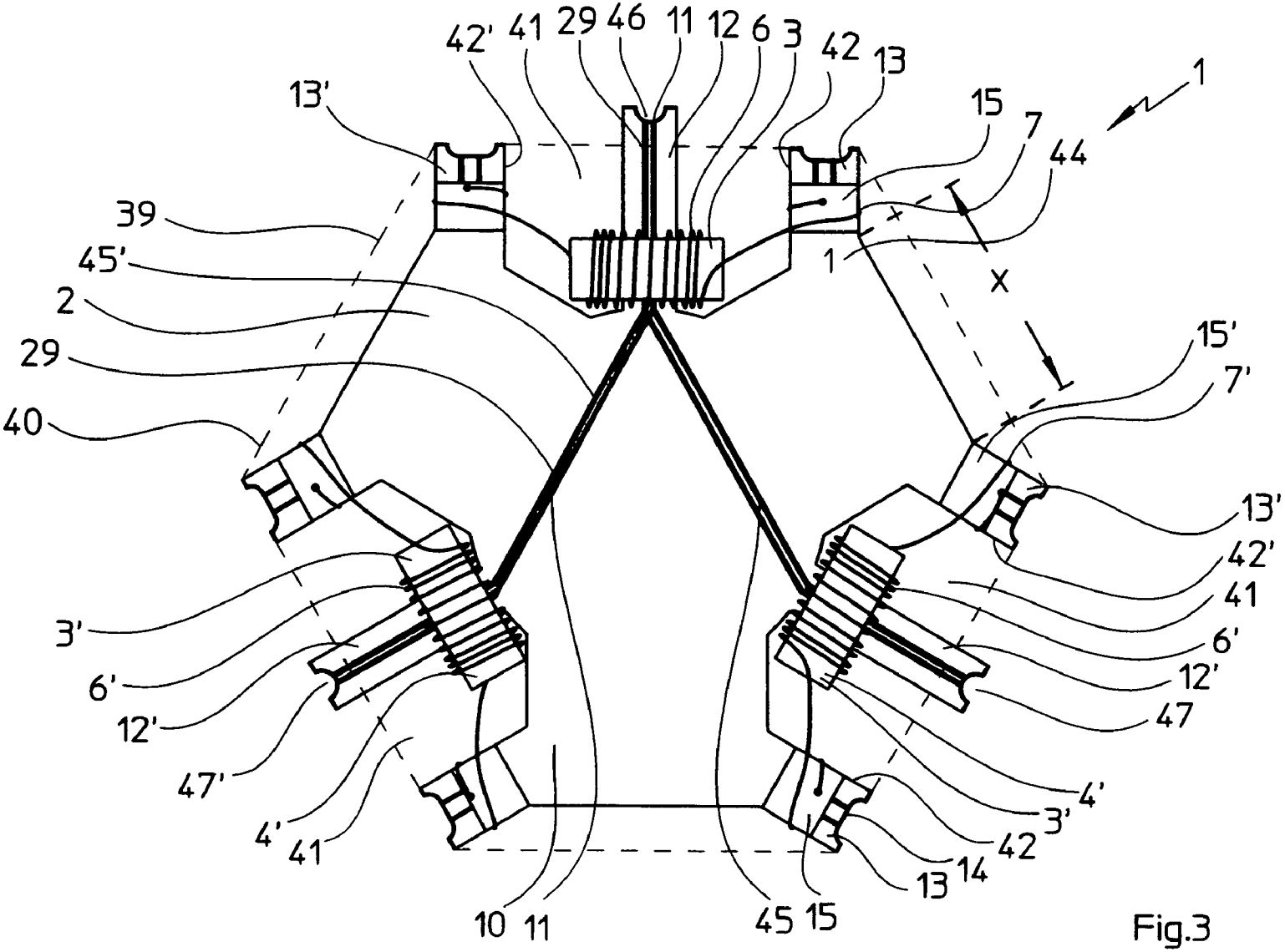

Some embodiments of the invention are presented purely schematically in the drawings and will be described in detail below. The printed conductors 11 represented in FIGS. 1-3 are normally contained in substrate 10 and are not visible. For better understanding and explanation, printed conductors 11 are shown on the surface of substrate 10.

Figure 4:
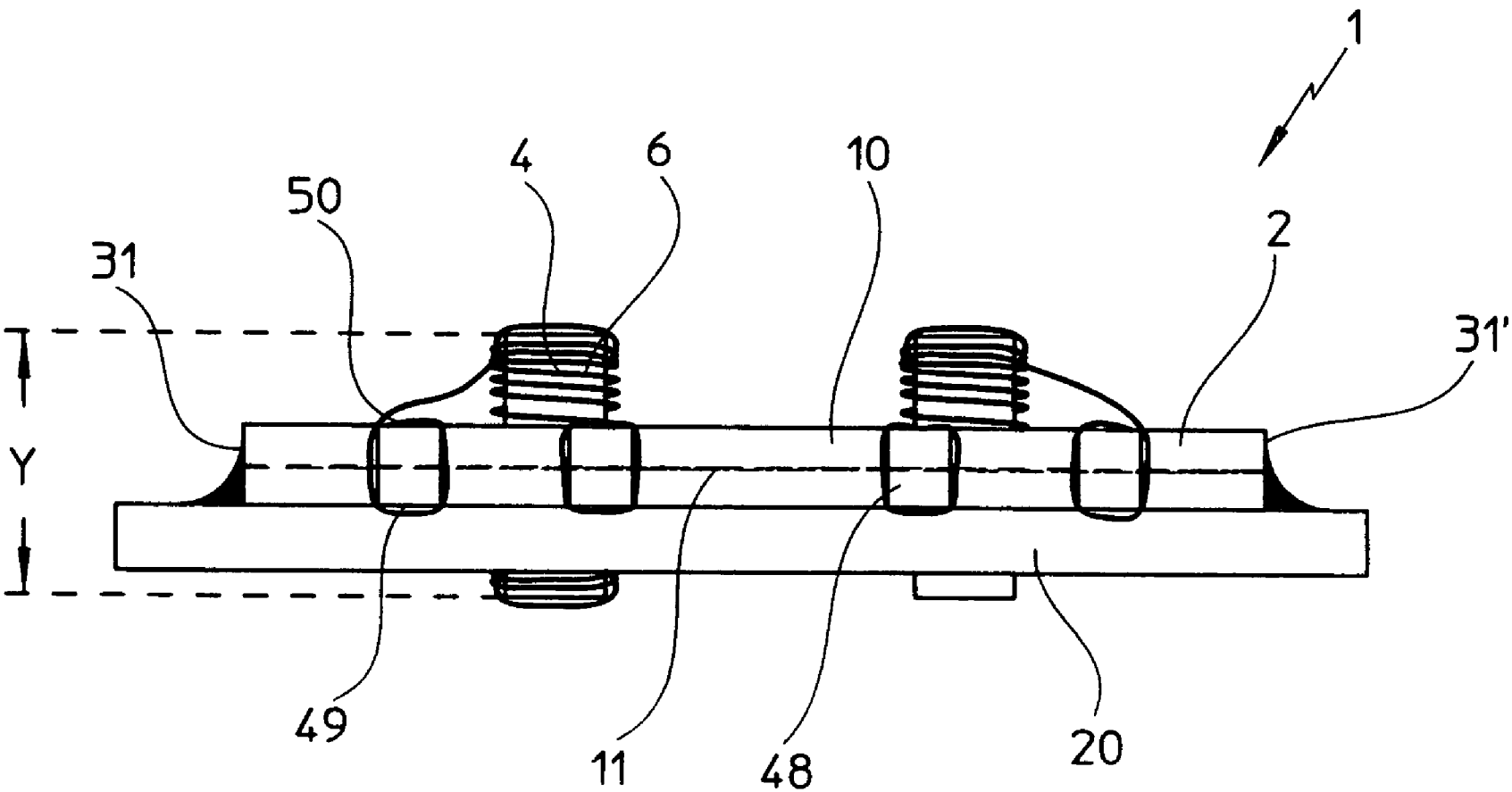

FIG. 1 shows a plan view of a schematic representation of a transformer integrated into a circuit board, and FIG. 2 shows an alternative arrangement of a transformer with a spacer element between two inductive components, and FIG. 3 shows an additional arrangement of a transformer with three inductive components connected in parallel, and FIG. 4 shows a side view of FIG. 1.

A transformer 1 integrated in an opening 22 of the circuit board 20 is shown in a schematic representation in FIG. 1, wherein transformer 1 consists of a component 2 with a magnetic core 4, 4' of soft magnetic material having a central hole 5 (not shown) through which one or more windings 6, 6' of insulated wire 7 are led, and of a substrate 10 with interior printed conductors 11, which is a support for one or more completed magnetic cores 4, 4' and 6, 6'; it comprises one or more webs 12, 12' in which one or more interior printed conductors 11 are arranged, as well as one or more connection arms 13 consisting of a contact surface 14 that is metallized on its upper side 48 and on underside 49, for connecting inductive components 3, 3' to the electronic components (not shown) arranged on circuit board 20, and a metallized winding contact region 15 for fixing beginning turn 16 and final turn 17 of winding 6, 6', wherein component 2 yields a miniaturizable SMD component suitable for surface mounting and is equipped with at least two inductive components 3, 3'. In order for component 2 of transformer 1 to be mountable with SMD technology, substrate 10 is planar. Planar substrate 10 contains a surface 18 for suction pipette 19 (not shown) for mounting on circuit board 20. Suction pipette 19 seizes component 2 of transformer 1 at surface 18 and transports component 2 for mounting into circuit board opening 22, in which component 2 is integrated and connected to circuit board 20 via metallized contact surfaces 14 by soldering, bonding or the like. Cutout 23 of circuit board opening 22 is designed such that the two inductive components 3, 3' are fixed in board opening 22 after the mounting of component 2 in such a manner that there is no possibility of outward lateral displacement of inductive components 3, 3'. An inward displacement of the two inductive components 3, 3' towards the center of the substrate is likewise impossible because of the boundary or the ends of the webs. Planar substrate 10 further comprises two webs 12, 12' onto which the wound annular cores are pushed, in the middle running in the longitudinal direction of substrate 10 on the same center axis and away from one another in opposite directions. There are also designs in which mounting can be accomplished by an SMD mounting robot. Substrate 10 can therefore be prefabricated. Web 12, 12' reaches through central hole 5 of inductive components 3, 3', with inductive component 3' forming the primary component and the other inductive component 3' forming the secondary component. Inductive component 3 thus consists of a magnetic core 4 with a primary winding 6, and inductive component 3' of a magnetic core 4' with a secondary winding 6', wherein magnetic cores 4, 4' are formed from annular cores 8, 8'. Magnetic cores 4, 4' can alternatively also be formed as rectangular ferrite cores. The two completed magnetic cores 4, 6 and 4', 6' are coupled by printed conductor 11 inside substrate 10 that is run through central hole 5 of annular cores 8, 8', printed conductor 11 in the substrate being formed from a printed circuit. The two other printed conductors 24, 25 arranged in substrate 10 run outside the inductive components 3 3'. Printed conductors 11, 24, 25 exit at end faces 31, 31' of substrate 10 and are connected there on circuit board 20 by soldering, for instance, whereby windings result. If, as is shown in FIG. 1, three printed conductors 11, 24, 25 are connected to one another on substrate 10, two windings 32, 37 result. Each winding 32 and 37 forms a planar short-circuit winding 33, which couples primary winding 6 to secondary winding 6'. Printed conductors 11, 24, 25 running inside substrate 10, which produce the coupling of the two inductive components 3, 3', are surrounded by at least 0.5 mm of insulating material 35 and have an edge distance corresponding to the provisions of the standards EN 50020 and EN 50014, whereby component 2 of transformer 1 meets the requirements for intrinsic safety.

The transformer 1 represented in FIG. 2 represents an alternative arrangement of a structural configuration with respect to FIG. 1, and can likewise be prefabricated. SMD-capable mounting is possible if a small flat surface (not shown) for the suction pipette is produced on the upper side of circular spacer sleeve 27. Web 12 in substrate 10 is not accessible from two sides as in FIG. 1, which results in two webs 12, 12', but from only one side, whereby one longer web 12 results. Web 12 is therefore the carrier of two inductive components 3, 3'. Inductive components 3, 3' are arranged one after the other and spaced apart by element 26. Element 26 is preferably a spacer sleeve 27 consisting of insulating material 34, and is pushed during assembly between the two inductive components 3, 3' onto web 12. With a flat surface (flattening not shown) on spacer sleeve 27, a mounting robot can be used for mounting. The distance between the two inductive components 3, 3' can be adapted to a wide variety of standard specifications, not only the EX specification, by different lengths of spacer sleeve 27. As described in FIG. 1, the two inductive components 3, 3' are coupled to one another with two planar windings 32, 37 via printed conductors 11, 24, 25, whereby two short-circuit windings 33 result. Alternatively, printed conductor 11, 24, 25 can consist, as shown in FIG. 2, of two parallel printed conductors 11, 29 a slight distance apart, and of printed conductors 24, 29 and printed conductors 25, 29 for coupling the two inductive components 3, 3'. The other properties of this component 2, for instance those of connection arms 13, correspond as those described in FIG. 1.

FIG. 3 shows an additional arrangement of a structural configuration of a transformer 1. Component 2 of transformer 1 corresponds in the imaginary line of outer contour 39 roughly to a symmetrical hexagon 40 with three cutouts 41 in a spacing of 120° from one another. A respective web 12, 12' directed perpendicularly outwards, which serves for accommodating an inductive component 3, 3', is arranged in the center line of cutouts 41. The two parallel inner sides 42, 42' of cutouts 41 are adjoined by connection arms 13, 13', which likewise run parallel to web 12 and are formed, as in FIG. 1, with context surfaces 14 and winding contact regions 15. The spread-out connection arms 13, 13' are arranged according to the invention in such a manner that they are likewise separated from one another by 120° in order to achieve the largest possible distance "X" between winding contact regions 15, 15' for insulated wires 7, 7' of windings 6, 6'. This distance "X" guarantees the necessary separation between two galvanically separated areas for protection type "intrinsic safety" of transformer 1 and thus satisfies the criteria of standard EN 50020. This component 2 is completed with three inductive components 3, 3', of which one inductive component 3 is equipped with a primary winding 4 and two inductive components 3' arranged in parallel thereto are equipped with a secondary winding 4'. Suction can be applied to transformer 1 in the center of substrate 10 by a suction pipette (not shown) and it can be mounted by SMD with the aid of an SMD mounting robot 21. For mounting the substrate 10 with primary inductive component 3, a web 12 and/or a contact arm 13 is labeled with an identification number "1" or in the form of a pin number 44. The identification number "1" allows a secure orientation of component 2 by SMD mounting robot 21 during the mounting of component 2 in opening 22 of circuit board 20. After the mounting of input-side inductive component 3 with primary winding 6 on web 12, the two output-side inductive components 3' with secondary winding 6' are mounted on webs 12'. Webs 12, 12' and substrate 10 are formed with continuous internal printed conductors 11, as known from FIG. 1. Printed conductor 11 can be one or more printed conductors 11. In this structural arrangement, there are two printed conductors 11, 29 parallel to one another and a slight distance apart. The special feature of printed conductors 11, 29 is that printed conductors 11, 29 branch off on the output side of primary input side 46 in two directions 45, 45' for connection to the two secondary output sides 47, 47'. In this implementation as well, the short-circuit windings are only completed by soldering onto circuit board 20. The other properties of this component 2, for instance those of connection arms 13, correspond as those described in FIG. 1.

FIG. 4 shows transformer 1 with component 2 according to FIG. 1 integrated into circuit board 20 in a side view, from which the low overall height "Y" less than or equal to 4.6 mm is quite visible. The overall height "Y" is determined by magnetic core 4 and its winding 6. Printed conductors 11 in the interior of substrate 10 are connected to one another at end face 31 of substrate 10. The other properties of this component 2, for instance, those of connection arms 13, correspond as those described in FIG. 1.

LIST OF REFERENCE NUMBERS

1 Transformer
2 Component
3 Inductive component (primary)
3' Inductive component (secondary)
4 Magnetic core (primary)
4' Magnetic core (secondary)
5 Center hole
6 Winding (primary)
6' Winding (secondary)
7 Insulated wire
8 Annular core
8' Annular core
9 Free
10 Substrate
11 Printed conductor
12 Web
12' Web
13 Connection arm
13' Connection arm
14 Contact surface
14' Contact surface
15 Winding contact region
15' Winding contact region
16 Beginning winding
17 Final winding
18 Surface
19 Suction pipette
20 Circuit board
21 SMD mounting robot
22 Circuit board opening
23 Cutout
24 Printed conductor
25 Printed conductor
26 Element
27 Spacer sleeve
28 Free
29 Printed circuit

30 End face
31 End face
31' End face
32 Winding I
33 Short-circuit winding
34 Material
35 Insulating material
36 Overall height
37 Winding II
38 Free
39 External contour
40 Hexagon
41 Cutout
42 Interior side
42' Interior side
43 Free
44 Pin number
45 Direction
45' Direction
46 Input side
47 Output side
48 End side
49 Underside
50 Upper side
51 Free
52 Free
53 Free

The invention claimed is:

1. Transformer (1) comprising a miniaturized electronic subassembly (2) with:

a primary magnetic core (4) of a soft magnetic material having a center hole (5) through which a primary winding (6) of insulated wire (7) is run, in such a way as to form a primary inductive component (3);

a secondary magnetic core (4') of a soft magnetic material having a center hole (5) through which a secondary winding (6') of insulated wire (7) is run, in such a way as to form a secondary inductive component (3');

a substrate (10) with a web (12, 12'), wherein an internal printed conductor (11) is printed on the web, wherein the internal printed conductor (11) couples the primary and the secondary inductive components (3, 3'), wherein the primary and second inductive components (3, 3') are pushed onto the web (12, 12'), and wherein the web (12, 12') is the carrier of the primary and secondary inductive components (3, 3'); and one or more connection arms (13, 13') consisting of a contact surface (14, 14') for connecting the primary and secondary inductive components (3, 3') to the miniaturized electronic subassembly arranged on a circuit board (20), and with a contact wiring region (15, 15') for fixation of beginning turn (16) and final turn (17) of the winding (6).

2. Transformer (1) according to claim 1, characterized in that the substrate (10) is planar and is suitable for SMD mounting technology.

3. Transformer (1) according to claim 1, characterized in that the substrate (10) has a flat surface (18) for a suction pipette.

4. Transformer (1) according to claim 1, characterized in that the web (12) of the substrate (10) reaches through the center hole (5) of the inductive component (3).

5. Transformer (1) according to claim 1, characterized in that the magnetic core (4, 4') consists of an annular core (8).

6. Transformer (1) according to claim 1, characterized in that the magnetic core (4, 4') consists of a rectangular core (8).

7. Transformer (1) according to claim 1, characterized in that the coupling of the completed magnetic cores (4, 6) and (4', 6') arranged on the web (12) is performed by the internal printed conductor (11) in substrate (10) and the circuit board (20).

8. Transformer (1) according to claim 6, characterized in that the internal printed conductor (11) and printed conductors (24, 25) in the substrate (10) are connected at end face edges (31, 31') to yield at least one winding (32, 37).

9. Transformer (1) according to claim 8, characterized in that the at least one winding (32) forms at least one planar short-circuit winding (33) which couples the primary winding (6) to the secondary winding (6').

10. Transformer (1) according to claim 1, characterized in that the internal printed conductor (11) in the substrate (10) is surrounded by at least 0.5 mm of insulating material (35).

11. Transformer (1) according to claim 1, characterized in that the subassembly (2) satisfies standard EN 50020 for intrinsic safety.

12. Transformer (1) according to claim 1, characterized in that the overall height (36) of ee the subassembly (2) is less than or equal to 4.6 mm.

* * * * *